US007398732B2

(12) United States Patent
Hebert et al.

(10) Patent No.: US 7,398,732 B2
(45) Date of Patent: Jul. 15, 2008

(54) METHOD FOR DETERMINING AN IMAGE AREA TO BE EXPOSED ON A PRINTING PLATE

(75) Inventors: Thomas K. Hebert, Groveland, MA (US); Terrence Michael Sangwine, Milton Keynes (GB)

(73) Assignee: Agfa Corporation, Wilmington, MA (US)

( * ) Notice: Subject to any disclaimer, the term of this patent is extended or adjusted under 35 U.S.C. 154(b) by 310 days.

(21) Appl. No.: 11/222,096

(22) Filed: Sep. 8, 2005

(65) Prior Publication Data

US 2007/0095233 A1 May 3, 2007

(51) Int. Cl.
*B41C 3/08* (2006.01)
*B41F 27/12* (2006.01)

(52) U.S. Cl. ..... 101/401.1; 101/477; 101/481; 101/485

(58) Field of Classification Search ..... 101/401.1, 101/477, 481, 483, 484, 485, 486
See application file for complete search history.

(56) References Cited

U.S. PATENT DOCUMENTS 6,233,038 B1 * 5/2001 Lennhoff et al. ..... 355/47
6,815,702 B2 * 11/2004 Kiermeier et al. ..... 250/559.36
7,225,737 B2 * 6/2007 Gelbart et al. ..... 101/463.1

* cited by examiner

*Primary Examiner*—Ren Yan
(74) *Attorney, Agent, or Firm*—Robert A. Sabourin

(57) ABSTRACT

A method for aligning a printing plate, prior to imaging, on a platesetter includes the steps of: determining a leading edge of the printing plate; feeding the printing plate by the leading edge onto punch equipment resident on the platesetter; centering the printing plate on the platesetter along the leading edge; punching one or more notches along the leading edge of the printing plate according to a predetermined punch configuration; securing the leading edge and a trailing edge to a support surface of the platesetter with respect to registration pins located on platesetter; determining a location of a vertical edge of one of the notches, the vertical edge defined as being perpendicular to the leading edge; and determining a location with respect to the vertical edge of the one notch for transferring an image onto the printing plate.

2 Claims, 4 Drawing Sheets

METHOD FOR DETERMINING AN IMAGE AREA TO BE EXPOSED ON A PRINTING PLATE

BACKGROUND OF THE INVENTION

1. Field of the Invention

The invention relates generally to a method for determining an image area to be exposed on a lithographic printing plate, and more particularly, to a method for reducing tolerances and margins of error when determining an imaging area of a lithographic printing plate on a platesetter or imagesetter.

2. Description of the Prior Art

Printing plates are imaged on internal drum, external drum and flatbed imagesetters and platesetters where an image is transferred from an imaging head to the printing plate via a laser beam. Printing plates can be black and white or they can represent color separations, such as cyan, magenta, yellow and black.

A finished printing plate is used on a printing press to transfer ink to a substrate such as paper. The mechanics of the printing press requires that the printing plate must be accurately positioned and aligned on the printing press. This is typically accomplished by aligning and engaging pins on the printing press with slots or notches that have been cut along the non-imaged edges of the printing plate. The positioning of these notches is critical with respect to the edges of the printing plates and the location of the image that is transferred onto the printing plate. Misalignment or variation in the positioning of the image on the printing plate with respect to the edges of the printing plates and the notches along the edges of the printing plates can cause problems in printing an accurate image onto the final print medium (often paper, although the same applies to any known print mediums).

The above problems associated with misalignment or variation in the positioning of the image on the printing plate, with respect to the edges of the printing plates and the notches along the edges of the printing plates, are corrected in view of the current invention as claimed and described in the following description and drawings.

SUMMARY OF THE INVENTION

A method for aligning a printing plate, prior to imaging, on a platesetter includes the steps of: determining a leading edge of the printing plate; feeding the printing plate by the leading edge onto punch equipment resident on the platesetter; centering the printing plate on the platesetter along the leading edge; punching one or more notches along the leading edge of the printing plate according to a predetermined punch configuration; securing the leading edge and a trailing edge to a support surface of the platesetter with respect to registration pins located on platesetter; determining a location of a vertical edge of one of the notches, the vertical edge defined as being perpendicular to the leading edge; and determining a location with respect to the vertical edge of the one notch for transferring an image onto the printing plate.

BRIEF DESCRIPTION OF THE DRAWINGS

The aforementioned aspects and other features of the invention are described in detail in conjunction with the accompanying drawings, not necessarily drawn to scale, in which the same reference numerals are used throughout for denoting corresponding elements and wherein.

DETAILED DESCRIPTION OF THE PREFERRED EMBODIMENTS

Figure 1:
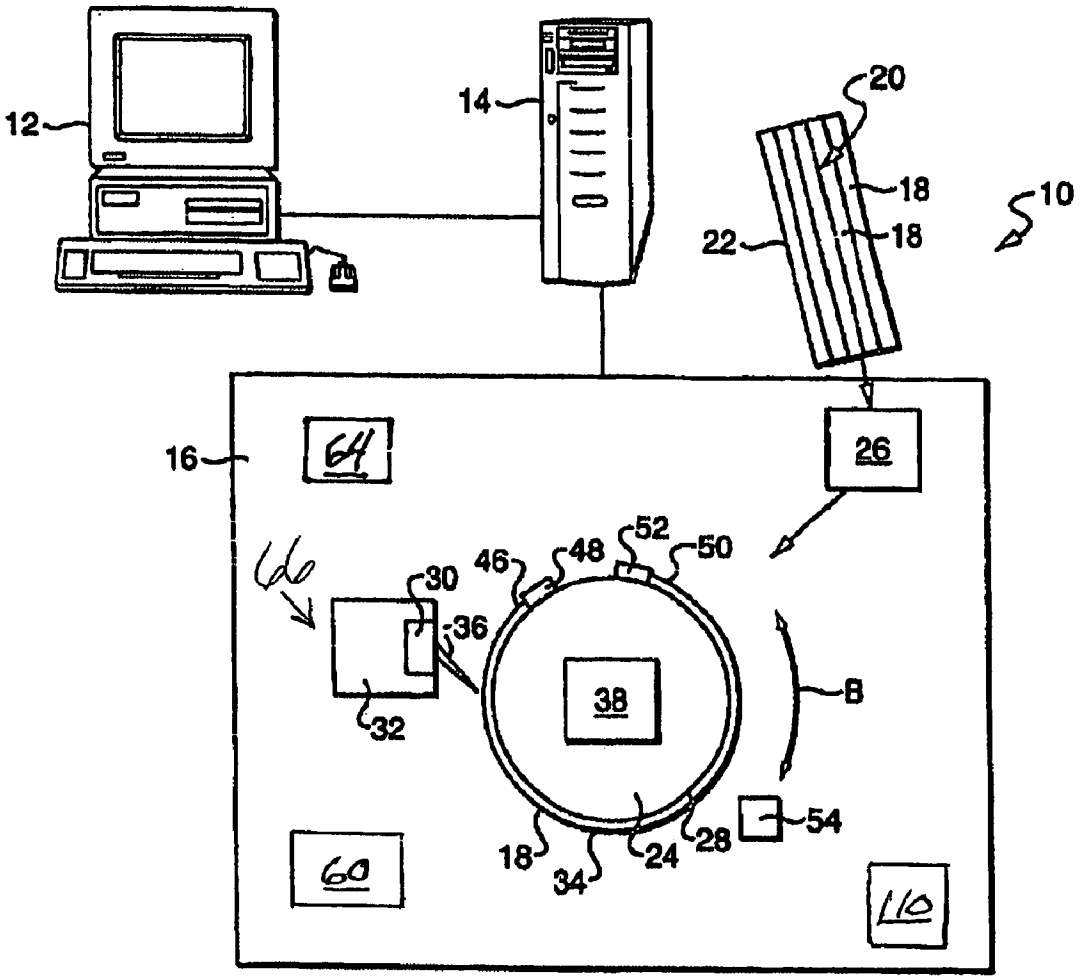
FIG. 1 is a diagrammatic view of a platemaking system for transferring an image onto a printing plate.

The features of the present invention are illustrated in detail in the accompanying drawings, wherein like reference numerals refer to like elements throughout the drawings. Although the drawings are intended to illustrate the present invention, the drawings are not necessarily drawn to scale.

The present invention is directed towards a method for aligning and positioning an area to be imaged on a lithographic printing plate (hereinafter "printing plate") or any media used for making a printing plate. The method can be implemented on any system used for imaging a punched printing plate, i.e. for transferring or exposing an image on a printing plate. Once imaged, the printing plate is to be used on a printing press for lithographic printing.

One embodiment of a system for imaging a printing plate is an external drum imaging system 10 as illustrated in FIG. 1. Other systems include internal drum imaging systems and flat bed imaging systems for making printing plates. In the broadest sense, the method of the present invention for aligning an image to be exposed onto a printing plate may be used on any system that transfers an image to a printing plate, for example, an imagesetter or platesetter. Moreover, the method can also be used in the course of imaging a color separation media, such as a cyan, magenta, yellow or black film.

In the embodiment of FIG. 1, the imaging system 10 includes an external drum platesetter configured to record digital data onto a printing plate 18.

The imaging system 10 generally includes a front end computer or workstation 12 for the design, layout, editing, and/or processing of digital files representing pages to be printed, a raster image processor (RIP) 14 for processing the digital pages to provide rasterized page data (e.g., rasterized digital files) for driving an image recorder or imaging head 66, and an imaging engine, such as an external drum platesetter 16, for recording the rasterized digital files onto a printing plate 18. The system 10 also includes a drum encoder 60 for positional alignment of the external drum 24, and a recorder encoder 64 for keeping track of the position of a laser scan line 68 which records an image onto the printing plate 18.

A stack 20 of printing plates 18 is commonly supplied in a cassette 22. A printing plate 18 is picked off of the stack 20 and subsequently delivered to the external drum platesetter 16 by an autoloading system 26.

The external drum platesetter 16 includes punches 72 and related mechanism, and an external drum 24 having a cylindrical media support surface 28 for supporting a printing plate 18 during imaging. The external drum platesetter 16 further includes an imaging head 66 which includes a laser imager or scanning system 30, coupled to a movable carriage 32, for recording digital data onto the imaging surface 34 of the printing plate 18 using single or multiple imaging beams 36.

The external drum 24 is rotated by a drive system 38 in a clockwise or counterclockwise direction as indicated by directional arrow B in FIG. 1. Typically, the drive system 38 rotates the external drum 24 at a rate of about 200 rpm. The scanning system 30 includes a radiation source for generating and emitting the imaging beam or beams 36, and an optical system positioned between the radiation source and the media support surface 28 for focusing the imaging beam or beams 36 onto the printing plate 18.

In the external drum imaging system 10 shown in FIG. 1, the leading edge 46 of the printing plate 18 is held in position against the media support surface 28 of the external drum 24 by a leading edge clamping mechanism 48. Similarly, the trailing edge 50 of the printing plate 18 is held in position against the media support surface 28 of the external drum 24 by a trailing edge clamping mechanism 52.

In addition to the printing plate 18 being held in position by the leading and trailing edge clamping mechanisms 48, 52 a vacuum source 54 may be used to draw a vacuum through an arrangement of ports and vacuum grooves to hold the printing plate 18 against the media support surface 28 of the external drum 24.

A registration system including, for example, a set of registration pins 70 on the external drum 24, and a plate edge detection system may be used to accurately and repeatably position and locate each printing plate 18 on the external drum 24.

Figure 2:
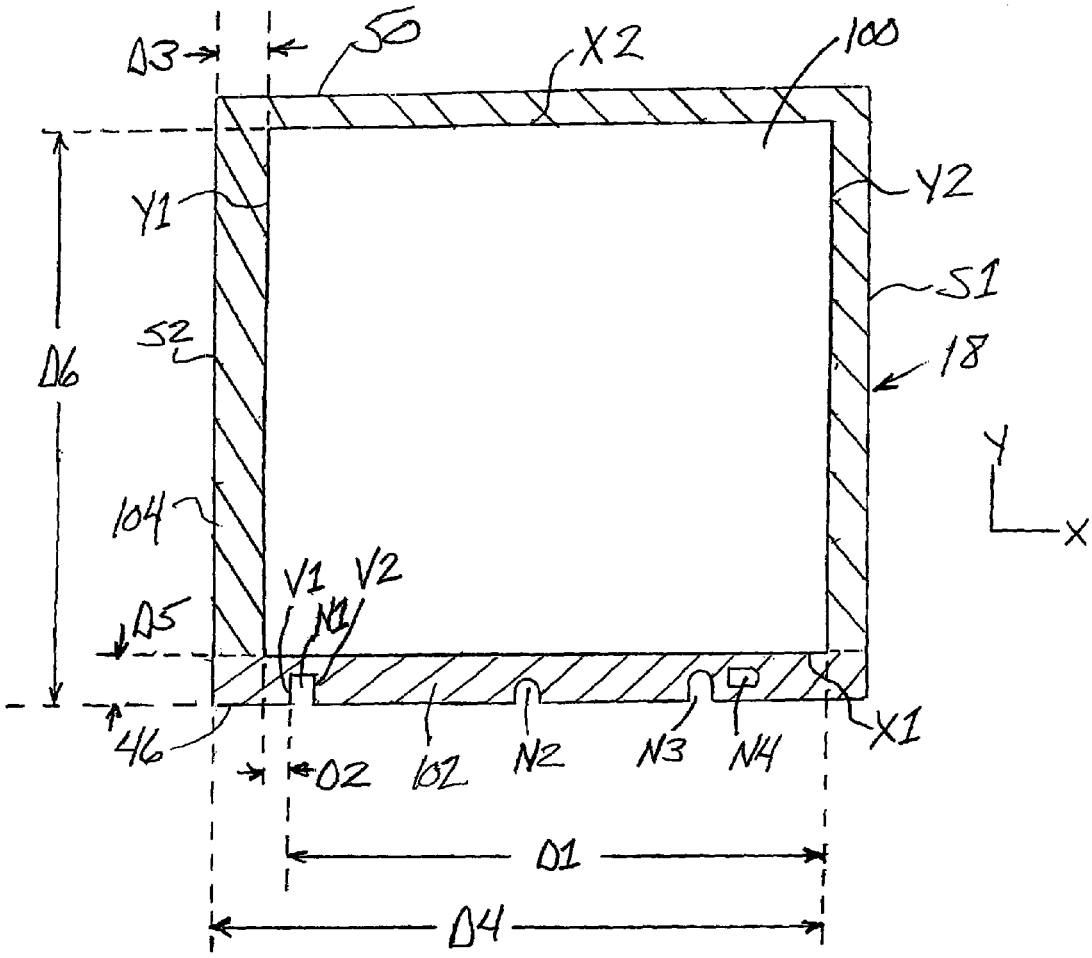
FIG. 2 is a top view of a punched printing plate.

The method of the present invention for determining an image area to be exposed on a printing plate is explained with reference to the printing plate 18 illustrated in FIG. 2. The plate 18 includes a leading edge 46, a trailing edge 50, side edges S1 and S2, an imaging area 100 in which an image will be exposed, a first border area 104 and a notch border area 102. The notch border area 102 includes a predetermined configuration of notches N1, N2, N3 and N4. The notch configuration is determined according to the particular printing press on which the plate 18 will be used. For example, a Heidelberg press may require a different punch configuration than a Komori press.

Figure 3:
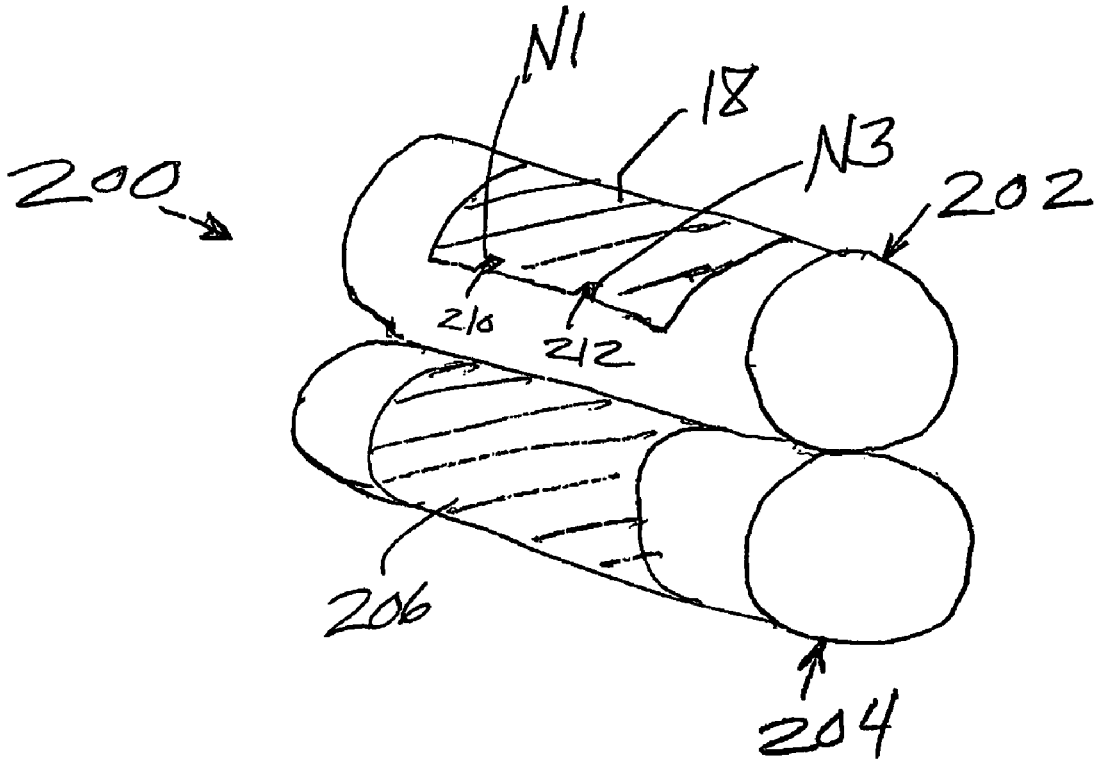
FIG. 3 is a diagrammatic side perspective view of a portion of a printing press that utilizes the printing plate of FIG. 2.
Figure 4:
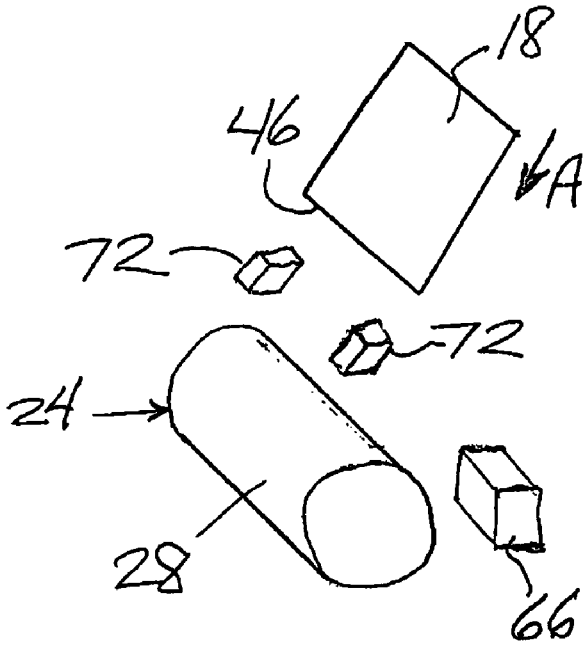
FIG. 4 is perspective view of portions of the platemaking system of FIG. 1.
Figure 5:
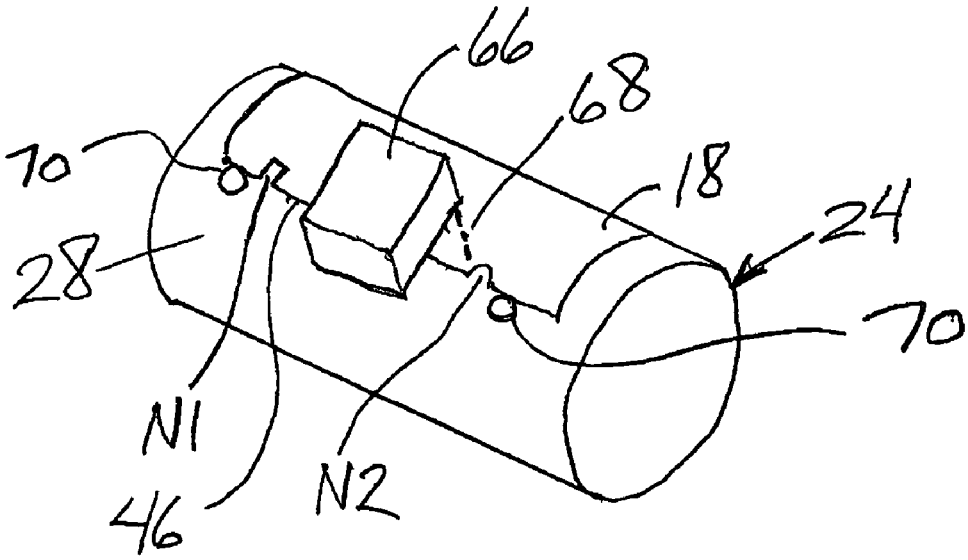
FIG. 5 is a perspective view of the printing plate of FIG. 2 mounted on an external drum of a platemaking system as in FIG. 1.

As shown in FIG. 3, a printing press typically includes: a plate cylinder 202 paired with a blanket cylinder 204 where the printing plate 18 is mounted onto the plate cylinder 202 and the blanket cylinder 204 includes a blanket 206 mounted thereon to carry ink for transfer onto paper.

After an image is transferred to the printing plate 18, the plate will be mounted onto the press plate cylinder 202 by interlocking plate mounting pins 210, 212 located on the plate cylinder with notches punched into the notch border area of the printing plate. In this example, the particular printing press requires that the pins 210, 212 must interlock, respectively, with the two particular notches N1, N3 as shown in FIG. 3. In the case of color separations, e.g cyan, magenta, yellow and black, four plate cylinders would be used on a printing press, one for each color.

The size, shape and location of the notches punched along the notch border area 102 of the printing plate 18 will vary according to the requirements of the particular press. In this example, the notch N1 is rectangular in shape having two vertical sides V1 and V2 which are perpendicular to the leading edge 46 of the printing plate 18. Notch N3 includes a predetermined radius as shown.

The inventive method for determining an imaging area 100 to be exposed on a printing plate 18 includes the following steps.

First a leading edge of a printing plate is determined. In FIG. 2 the leading edge has been determined as edge 46. The printing plate 18 is transferred from the plate cassette 20 via the autoloader 26 by way of the leading edge 46 to the external drum platesetter 16. The punching equipment within the platesetter is engaged to accept the printing plate 18 and it registers the leading edge 46 of the printing plate on pin contacts 70.

With the printing plate 18 registered on the pin contacts 70, another mechanism of the punching equipment centers the plate 18 automatically into symmetry with a predetermined punch configuration. After completion of the centering task, the punches 72 are activated. Since the punches 72 are always in a fixed position, each punched plate 18 of a given size for a given configuration will have holes punched on the printing plate 18 within a symmetry tolerance of one millimeter, where the punched holes will be identical with respect to size and spacing.

Subsequent to successful punching, the printing plate 18 is extracted from the punch equipment which is in turn, retracted, and the platesetter propagates the printing plate 18 onto the support surface 28 where it is again registered to the leading edge 46 by registration pins 70 located in the vicinity of the leading edge clamping mechanism 48.

Once the printing plate 18 has been manipulated onto the support surface 28 and the leading edge 46 is registered to the registration pins 70 on the external drum 24, then the leading edge 46 is fixed by leading edge clamping mechanism 48.

The predetermined punch configuration information is, for example, stored in software which operates the platesetter, for example software located in the computer 12 or in a controller 110 located within the platesetter. An operator or computer programmer can input the punch configuration data into the computer or controller.

In the present embodiment, the punch configuration includes notches N1 and N3 which are punched while the plate 18 is secured and supported by the leading edge within the platesetter punching equipment. In another embodiment, a separate punching machine (i.e. not part of the platesetter 16) is used to punch out the notches prior to mounting the printing plate 18 onto the platesetter 16.

Some platesetters require a machine notch N2 for mounting the plate 18 onto the platesetter 16 in cooperation with a mounting pin prior to any punching and/or imaging operations. In yet another variation, some systems provide a single dual-pin punch having a pair of notches such as the machine notch N4 and the punch notch N3 which together are used for mounting and aligning the plate 18 onto the support surface 28 of the external drum 24 of the platesetter 16. By using a dual pin punch, the positional relationship between notches N3 and N4 will be consistent with negligible positional variation from plate to plate. However, these systems require punches other than those required by the printing press, making them costly.

Once the printing plate 18 is secured onto the support surface 28, it is ready for imaging, i.e. transferring an image to the printing plate 18. The exact location for exposing an image on the printing plate 18 must be determined. As shown in FIG. 2, the imaging area 100 is surrounded on 4 sides by the first border area 104 and the punch border area 102. These border areas will be exposed as well as a predetermined image in the imaging area 100. The image will be transferred by exposing the printing plate 18 with a laser beam 36 originating in a laser imager 30.

In the past the alignment of the imaging area 100 in the X direction was accomplished by referencing the side S2 of the printing plate 18, then determining a distance D3 to establish the left boundary Y1 of the imaging area 100. Similarly by referencing the side S2 of the printing plate 18, a distance D4 was determined to establish the right boundary Y2 of the imaging area 100.

In a similar fashion, the alignment of the imaging area 100 in the Y direction has been determined by referencing the leading edge 46 of the printing plate 18 to a drum encoder index and then determining a distance D5 to establish a lower boundary X1 of the imaging area 100. Similarly by referencing the leading edge 46 of the printing plate 18, a distance D6 was determined to establish an upper boundary X2 of the imaging area 100.

According to a preferred embodiment of the method of the present invention, a determination for positioning the imaging area 100 for exposing an image onto a printing plate 18 is accomplished as follows.

One of the notches punched into the plate 18 is configured to include a vertical surface that is perpendicular to the leading edge 46 of the printing plate 18. The example of FIG. 2 includes two vertical edges V1 and V2 of notch N1. In this case, we will select the vertical edge V1 to be used as the vertical reference edge for determining the imaging area 100. Alternatively, V2 could also be used as the reference vertical edge.

Using V1 as the vertical reference edge, the left edge Y1 of the imaging area 100 is calculated as the distance D2 from the vertical reference edge V1. Similarly, the right edge Y2 of the imaging area 100 is calculated as the distance D1 from the vertical reference edge V1. This technique differs from the past methods of determining the edges Y1 and Y2 of the imaging area 100 by using the plate edges S1 or S2 as the vertical reference edge.

By implementing the method according to the invention, the imaging area is more accurately and consistently positioned from plate to plate on press.

Under the prior methods for determining the imaging area 100 on a printing plate, at least two tolerances existed for positional error in the X-direction. The first tolerance was any error introduced while determining the distances D3 and D4 from the left edge S2 of the printing plate 18 to the left edge Y1 of the imaging area 100. The second tolerance was any error introduced while determining the distances D2 and D1 from the vertical edge V1 of the notch N1 and the left edge Y1 of the imaging area 100.

According to the principles of the present invention, the first tolerance mentioned above is eradicated and only the second tolerance remains as a factor for horizontal positional error in determining the position of the imaging area 100 to be exposed on the printing plate 18. This result has been proven by empirical testing. In fact, the horizontal positioning of the imaging area 100 on a printing plate using the inventive method decreases error and increases consistency in color duplication over four separations.

The above described embodiments are merely illustrative of the present invention and represent a limited number of the possible specific embodiments that can provide applications of the principles of the invention. Numerous and varied other arrangements may be readily devised in accordance with these principles by those skilled in the art in keeping with the invention as claimed.

The invention claimed is:

1. A method for aligning a printing plate, prior to imaging, on a platesetter comprising the steps of:

determining a leading edge of the printing plate;

feeding the printing plate by said leading edge onto punch equipment resident on the platesetter;

centering the printing plate on the platesetter along the leading edge;

punching one or more notches along the leading edge of the printing plate according to a predetermined punch configuration;

securing the leading edge and a trailing edge to a support surface of the platesetter with respect to registration pins located on platesetter;

determining a location of a vertical edge of one of said notches, said vertical edge defined as being perpendicular to the leading edge; and determining a location with respect to the vertical edge of said one notch for transferring an image onto the printing plate.

2. The method of claim 1 wherein said predetermined punch configuration corresponds to a punch configuration required for mounting said printing plate onto a particular printing press.

* * * * *